US007430279B2

(12) United States Patent
Freudenberger et al.

(10) Patent No.: US 7,430,279 B2
(45) Date of Patent: Sep. 30, 2008

(54) ROTATING ENVELOPE X-RAY TUBE

(75) Inventors: Jörg Freudenberger, Eckental (DE); Ernst Neumeier, Aurachtal (DE); Matthias Seufert, Pettstadt (DE)

(73) Assignee: Siemens Aktiengesellschaft, Munich (DE)

( * ) Notice: Subject to any disclaimer, the term of this patent is extended or adjusted under 35 U.S.C. 154(b) by 25 days.

(21) Appl. No.: 11/545,371

(22) Filed: Oct. 10, 2006

(65) Prior Publication Data

US 2007/0092065 A1 Apr. 26, 2007

(30) Foreign Application Priority Data

Oct. 14, 2005 (DE) ..... 10 2005 049 273

(51) Int. Cl.
*H01J 35/10* (2006.01)

(52) U.S. Cl. ..... 378/141; 378/140

(58) Field of Classification Search ..... 378/119, 378/121–141
See application file for complete search history.

(56) References Cited

U.S. PATENT DOCUMENTS 2,900,543 A * 8/1959 Heuse ..... 378/130
5,384,820 A * 1/1995 Burke ..... 378/135
5,703,926 A 12/1997 Bischof ..... 378/200

FOREIGN PATENT DOCUMENTS

DE 103 35 664 B3 6/2005
EP 0 715 314 12/2000

* cited by examiner

*Primary Examiner*—Jurie Yun
(74) *Attorney, Agent, or Firm*—Schiff Hardin LLP

(57) ABSTRACT

A rotating envelope tube has a housing which with an x-ray exit window that is essentially transparent for x-ray radiation. To improve the mechanical stability, the x-ray exit window internally exhibits a structure through which cooling fluid can flow.

12 Claims, 1 Drawing Sheet

ROTATING ENVELOPE X-RAY TUBE

BACKGROUND OF THE INVENTION

1. Field of the Invention

The present invention concerns a rotating envelope x-ray tube (rotary piston x-ray tube) of the type having a housing with a beam exit window that is transparent to x-ray radiation.

2. Description of the Prior Art

A rotating envelope tube of the above type is, known for example, from DE 103 35 664 B3. In such rotating envelope tubes, an outer casing of the housing has an annular x-ray exit window produced from a material that is transparent for x-rays, cooling fluid circulates in an intermediate space formed between the outer casing and an inner casing permanently connected therewith. Due to centrifugal forces, in particular at high rotation speeds, the cooling fluid exerts a high pressure on the x-ray exit window. The maximum rotation speed and thus also the load capacity of the rotating envelope tube are limited, among other things, by the stability (strength) of the x-ray exit window.

SUMMARY OF THE INVENTION

An object of the invention is to provide a rotating envelope x-ray tube with further improved load capacity.

This object is achieved in accordance with the invention by a rotating envelope x-ray tube wherein the x-ray exit window internally exhibits a structure through which cooling fluid can flow, it is thereby made possible to fashion the x-ray exit window thicker. Because this the inventive structure allows cooling fluid to flow through the window, an effective cooling of the x-ray exit window is achieved. Overall the stability of the x-ray exit window can be distinctly increased. This in turn enables operation of the rotating envelope radiator at further increased rotation speeds and thus the load capacity of the rotating envelope tube is also increased.

In an embodiment of the invention, the housing has an inner casing and an outer casing permanently connected with the inner casing, and an intermediate space for passage of cooling fluid is formed between the inner casing and the outer casing. In this case the cooling fluid is thus rotated with the same rotation speed as the housing. This enables an exact restricted guidance of the cooling fluid and therewith a particularly effective cooling. In comparison to rotating envelope tubes in which the inner casing is not connected with the outer casing such that it rotates in a fixed manner therewith, the occurrence an unwanted friction between the cooling fluid and the inner casing is avoided. The inventive rotating envelope tube can be rotated with a comparably low drive power.

In a further embodiment the x-ray exit window has a wall that is impenetrable for cooling fluid, and this wall is on the external side of the housing formed by the outer casing. This enables a fluid-sealed design limited by the outer casing. In this case it is not necessary for the outer casing to be provided by with a further housing for accommodation of cooling fluid exiting via the x-ray exit window.

The x-ray exit window appropriately extends radially inwardly from the outer casing into the intermediate space. According to a particularly advantageous embodiment, the x-ray exit window extends from the outer casing across the intermediate space up to the inner casing and is connected with the inner casing without slippage. A particularly mechanically stable embodiment of the x-ray exit window is thereby achieved. This embodiment enables a particularly high load capacity of the rotating envelope tube.

The intermediate space is advantageously connected with the structure through which cooling fluid can flow. Without further measures it is therewith possible to pass fluid flowing in the intermediate space through the structure. A special device is not required for supplying the structure through which cooling fluid can flow with cooling fluid. The structure through which cooling fluid can flow can be directly supplied with cooling fluid from the intermediate space and cooling fluid exiting from the structure through which cooling fluid can flow can be supplied again to the intermediate space.

According to a further embodiment, the structure can be formed from fixed structural elements and voids located between them. The fixed structural elements are essentially transparent for x-ray radiation, but they exhibit a somewhat lesser transparency in comparison to the voids situated between them. Each of the structural elements extends over a predetermined radial segment of the x-ray window. The structural elements are appropriately regularly arranged in the circumferential direction of the housing. In this case a structural element is provided by the geometry that recurs in the circumferential direction, this geometry resulting from the arrangement of the voids, Given a regular arrangement of the structure elements and of the voids in the circumferential direction, a modulation of the x-ray radiation exiting from the x-ray exit window (which modulation interferes with the image generation) can be avoided. It is particularly advantageous when a number N of absorber elements is selected such that the following relation applies:

$$T/N \ll 1/f,$$

wherein T is the rotation duration for one rotation of the rotating envelope, N is the number of the structural elements per revolution, and f is an image data readout rate.

Given a regular or periodic arrangement of the structural elements under consideration of the above relation, it is ensured that the structure does not interfere with the image generation.

According to a particularly advantageous embodiment, the structure is formed from a material that is porous or foam-like. Such material exhibits a communicating pore space. In particular, a material is used that is essentially transparent for x-rays. The structure produced from a porous or foam-like material is particularly rigid and simultaneously enables an excellent cooling of the x-ray exit window. The material can be a metal, for example aluminum, magnesium, titanium, a ceramic, or glass.

According to a further embodiment, the structure has a number of channels. The channels can be arranged essentially parallel to the rotational axis of the housing. The provision of the channels can be achieved relatively simply with an x-ray exit window produced from metal.

The x-ray exit window can form an annular segment of the housing. The production expenditure can thereby be reduced.

The x-ray exit window can be produced from one of the following materials: SiSiC, SSiC, LP:SiC, Al, Mg, Ti, SiC, $Al_2O_3$, AlN, $Si_3N_4$.

DESCRIPTION OF THE PREFERRED EMBODIMENTS

Figure 1:
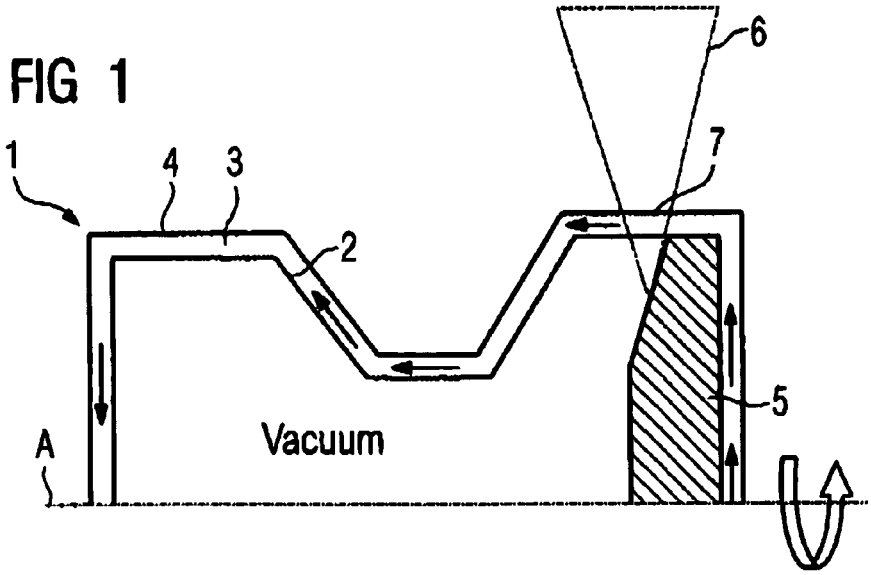
FIG. 1 is a sectional view portion of a rotating envelope tube in accordance with the invention.

In the rotating envelope tube shown in FIG. 1, a housing 1 has a vacuum-sealed inner casing 2 and an outer casing 4 surrounding the inner casing 2 to form an intermediate space 3. The direction of the flow of a cooling fluid accommodated In the intermediate space 3 is indicated with the arrows shown in the intermediate space 3. The inner casing 2 and the outer casing 4 are permanently connected with one another by a connection (not shown), such that during a rotation of the outer casing 4 the inner casing 2, the cooling fluid accommodated in the intermediate space 3 is rotated with the same speed, An anode that is permanently connected with the inner casing 2 or is a component thereof is designated with the reference character 5. An x-ray beam 6 radiated from the anode 5 penetrates the housing 1 in the region of an x-ray exit window 7. The axis of the rotating envelope tube is designated with the reference character A.

Figure 2:
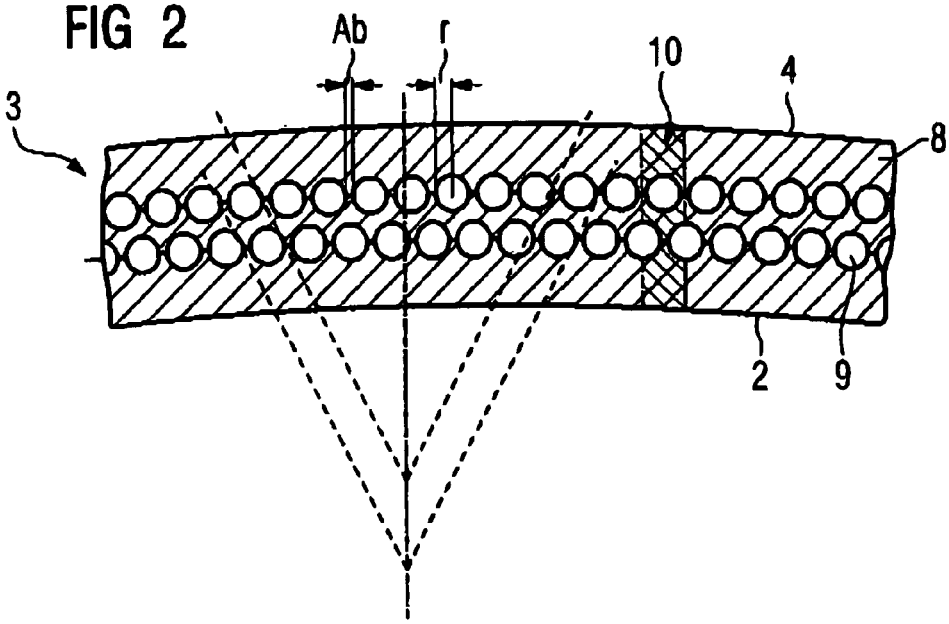
FIG. 2 is a section perpendicular to the axis of the rotating envelope tube through a portion of a first embodiment of an x-ray exit window in accordance with the invention.

FIG. 2 shows a section perpendicular to the axis A in the region of the x-ray exit window 7. A structure 8 (produced, for example, from aluminum) extends from the outer casing 4 across the intermediate space 3 to the inner casing 2. The structure 8 contains channels 9 running parallel to the axis A, the channels 9 being regularly arranged. In the exemplary embodiment, each of the channels 9 has four adjacent channels 9. The channels 9 each exhibit a radius r. The distance Ab between the channels 9 is selected to amount to 1.4 to 2 times (preferably 1.5 to 1.8 times) the radius r.

The structure 8 is connected with the outer casing 4 and the inner casing 2 without slippage. For example, the structure 8 can form a ring extending over the axial length of the x-ray exit window 7, the ring being produced in a one-piece fashion with a segment of the outer casing 4 and of the inner casing 2. Alternatively the structure 8 can be inserted into the intermediate space 3 formed between the outer casing 4 and the inner casing 2, and connected without slippage to the outer casing 4 and the inner casing 2, for example by means of welding, soldering or the like.

Figure 3:
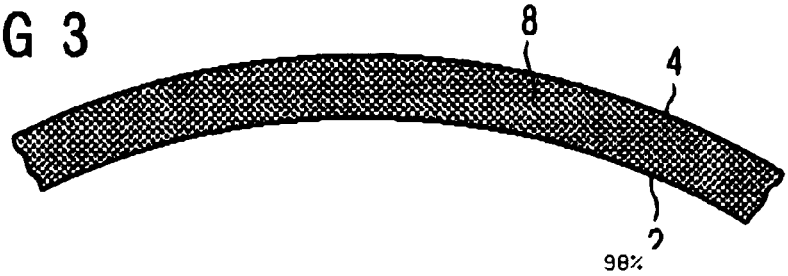
FIG. 3 is a section perpendicular to the axis of the rotating envelope tube through a portion of a second embodiment of an x-ray exit window in accordance with the invention.

FIG. 3 shows a sectional view perpendicular to the axis A through the x-ray exit window 7 of a further embodiment. In this embodiment the structure 8 is formed by a sintered metal that exhibits a communicating pore space. A "communicating pore space", means a pore configuration through which a cooling fluid can flow. Instead of a sinter metal, an open-pored ceramic, a metal foam or the like can be used.

The structure 8 preferably forms a regular pattern composed of structural elements and void 9. Such a regular pattern is also present in the embodiment of FIG. 2. The structure elements respectively correspond to the radial segments (designated with the reference character 10) of the structure 8. The number N of the structure elements 10 or their size results from the relation previously explained. This relation in particular depends on the rotation duration for a rotation of the rotating envelope as well as on the image data readout rate f.

As can be seen from FIG. 2, a series of channels 9 situated radially inwardly and a series of channels 9 situated radially outwardly are provided. The channels 9 are respectively offset from one another by half the interval Ab between two neighboring channels. A periodic attenuation results only to a certain degree for x-ray radiation radiating through the x-ray exit window 7.

The inventive x-ray exit window 7 in a simple manner compensates pressure forces formed within the x-ray exit window during a fast rotation. It has proven to be advantageous for the volume of the channels 9 or of the voids to be approximately equal to the volume of the structural elements 10 surrounding the channels 9 or the voids.

Although modifications and changes may be suggested by those skilled in the art, it is the intention of the inventors to embody within the patent warranted hereon all changes and modifications as reasonably and properly come within the scope of their contribution to the art.

We claim as our invention:

1. A rotating envelope x-ray tube comprising:

a housing having an x-ray exit window therein that is substantially transparent for x-ray radiation;

said housing comprising an inner casing and an outer casing connected with said inner casing by a connection that maintains said inner casing and said outer casing stationary relative to each other and that forms an intermediate space therebetween allowing a coolant to flow between said inner casing and said outer casing; and said x-ray exit window being stationarily held by and between said inner casing and said outer casing and internally comprising an interior structure through which said coolant can flow, said interior structure being in fluid communication with said intermediate space.

2. A rotating envelope x-ray tube as claimed in claim 1 wherein said x-ray exit window comprises a wall that is impenetrable to said coolant, said wall being disposed at an external side of said outer casing of said housing.

3. A rotating envelope x-ray tube as claimed in claim 1 wherein said x-ray exit window extends radially inwardly from said outer casing in to said intermediate space.

4. A rotating envelope x-ray tube as claimed in claim 1 wherein said x-ray exit window extends from said outer casing across said intermediate space to said inner casing, and is connected without slippage to said inner casing.

5. A rotating envelope x-ray tube as claimed in claim 1 wherein said interior structure comprises a plurality of fixed structural elements with voids disposed between said plurality of fixed structural elements.

6. A rotating envelope x-ray tube as claimed in claim 5 wherein said plurality of structural elements are arranged in a regular pattern in a circumferential direction of said housing.

7. A rotating envelope x-ray tube as claimed in claim 5 wherein said plurality of structural elements is N, and wherein $T/N \ll 1/f$, wherein T is a rotation duration for one rotation of said rotating envelope x-ray tube and f is an image data readout rate for a detector on which said x-ray radiation is incident.

8. A rotating envelope x-ray tube as claimed in claim 1 wherein said interior structure is formed of a material comprising a plurality of communicating pores.

9. A rotating envelope x-ray tube as claimed in claim 1 wherein said x-ray exit window comprises a window body containing a plurality of channels, forming said interior structure.

10. A rotating envelope x-ray tube as claimed in claim 9 wherein said housing has a rotational axis around which said housing rotates, and wherein said channels are disposed substantially parallel to said rotational axis.

11. A rotating envelope x-ray tube as claimed in claim 1 wherein said x-ray exit window forms an annular segment of said housing.

12. A rotating envelope x-ray tube as claimed in claim 1 wherein said x-ray exit window is comprised of a material selected from the group consisting of SiSiC, SSiC, LP:SiC, Al, Mg, Ti, SiC, $Al_2O_3$, AlN, $Si_3N_4$.

* * * * *